US010711527B2

(12) United States Patent
Lange et al.

(10) Patent No.: US 10,711,527 B2
(45) Date of Patent: Jul. 14, 2020

(54) DRILL BIT AND METHOD FOR CASING WHILE DRILLING

(71) Applicant: Halliburton Energy Services, Inc., Houston, TX (US)

(72) Inventors: Gustav Edward Lange, Alberta (CA); Bradley David Dunbar, The Woodlands, TX (US); Ludovic Delmar, Braine-l'Alleud (BE)

(73) Assignee: Halliburton Energy Services, Inc., Houston, TX (US)

( * ) Notice: Subject to any disclaimer, the term of this patent is extended or adjusted under 35 U.S.C. 154(b) by 163 days.

(21) Appl. No.: 15/739,703

(22) PCT Filed: Jul. 27, 2015

(86) PCT No.: PCT/US2015/042267
§ 371 (c)(1),
(2) Date: Dec. 23, 2017

(87) PCT Pub. No.: WO2017/019017
PCT Pub. Date: Feb. 2, 2017

(65) Prior Publication Data

US 2018/0195348 A1 Jul. 12, 2018

(51) Int. Cl.
*E21B 10/32* (2006.01)
*E21B 10/62* (2006.01)
*E21B 10/43* (2006.01)

(52) U.S. Cl.
CPC ..... *E21B 10/32* (2013.01); *E21B 10/43* (2013.01); *E21B 10/62* (2013.01)

(58) Field of Classification Search
CPC ..... E21B 10/26; E21B 10/62; E21B 10/64; E21B 7/20; E21B 7/002
See application file for complete search history.

(56) References Cited

U.S. PATENT DOCUMENTS 1,941,723 A * 1/1934 Stroud ..... E21B 7/04 175/321
3,169,592 A * 2/1965 Kammerer ..... E21B 10/64 175/257
3,635,295 A * 1/1972 Cobbs ..... E21B 10/64 175/257
3,945,444 A * 3/1976 Knudson ..... E21B 4/06 175/92

(Continued)

FOREIGN PATENT DOCUMENTS

CA 2973794 A1 * 8/2016 ..... E21B 7/20
EP 1837481 A1 * 9/2007 ..... E21B 4/10

(Continued)

OTHER PUBLICATIONS

PCT International Search Report and Written Opinion dated Mar. 31, 2016, issued in corresponding application No. PCT/US2015/042267 filed on Jul. 27, 2015, 15 pgs.

*Primary Examiner* — Jennifer H Gay
(74) *Attorney, Agent, or Firm* — Chamberlain Hrdlicka

(57) ABSTRACT

Methods, devices, and systems include a nested drill bit assembly, including an inner drill bit nested within an opening of an outer drill bit. The inner drill bit is removably coupled to the outer drill bit and the inner drill bit being co-axially positioned within the outer drill bit and accessible from a first end of the outer drill bit.

20 Claims, 9 Drawing Sheets

(56) References Cited

U.S. PATENT DOCUMENTS 5,472,057 A * 12/1995 Winfree ..... E21B 4/02 175/101
5,845,722 A * 12/1998 Makohl ..... E21B 7/208 175/101
6,857,487 B2 * 2/2005 Galloway ..... E21B 17/07 175/171
7,281,592 B2 * 10/2007 Runia ..... E21B 10/60 175/57
7,287,609 B2 * 10/2007 Runia ..... E21B 4/02 175/257
7,296,639 B2 * 11/2007 Millar ..... E21B 7/061 175/57
7,775,302 B2 8/2010 Warren
7,857,052 B2 12/2010 Giroux et al.
8,550,190 B2 * 10/2013 Hall ..... E21B 10/62 175/385
8,757,298 B2 * 6/2014 Broussard, Jr. ..... E21B 10/04 175/398
10,107,045 B2 * 10/2018 Nakamura ..... E21B 7/208
2004/0118611 A1 * 6/2004 Runia ..... E21B 4/02 175/57
2004/0238218 A1 * 12/2004 Runia ..... E21B 10/60 175/57
2006/0021801 A1 * 2/2006 Hughes ..... E21B 10/64 175/385
2006/0027399 A1 * 2/2006 Holte ..... E21B 10/40 175/57
2010/0181112 A1 7/2010 Radford et al.
2011/0120774 A1 * 5/2011 Runia ..... E21B 10/48 175/57
2011/0214920 A1 9/2011 Vail, III et al.
2011/0240366 A1 * 10/2011 Hall ..... E21B 10/26 175/57
2012/0273275 A1 * 11/2012 Broussard, Jr. ..... E21B 7/002 175/57
2012/0298426 A1 * 11/2012 Eason ..... B05D 5/02 175/425
2017/0081923 A1 * 3/2017 Nakamura ..... E21B 7/208
2018/0195348 A1 * 7/2018 Lange ..... E21B 10/62

FOREIGN PATENT DOCUMENTS

JP 2013122112 A * 6/2013 ..... E21B 7/20
WO 2014113315 A1 7/2014

* cited by examiner

DRILL BIT AND METHOD FOR CASING WHILE DRILLING

BACKGROUND

This disclosure generally relates to exploration and production of hydrocarbons involving investigations of regions of an earth formation penetrated by a borehole. More specifically, the disclosure relates to a nested drill bit arrangement configurable for types of earth formation and drilling multiple borehole sizes.

Generally, boreholes are drilled in multiple different sections. For example, each section of the borehole decreases in diameter as the borehole progresses deeper in the earth formation. The progressively smaller diameter borehole sections are drilled by progressively smaller diameter drill bits. When a new section of borehole having a smaller diameter is needed, the previous drill bit is tripped out of the borehole, new casing is run downhole, and a new smaller diameter drill bit is run downhole to commence drilling the new section of borehole.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

Figure 1:
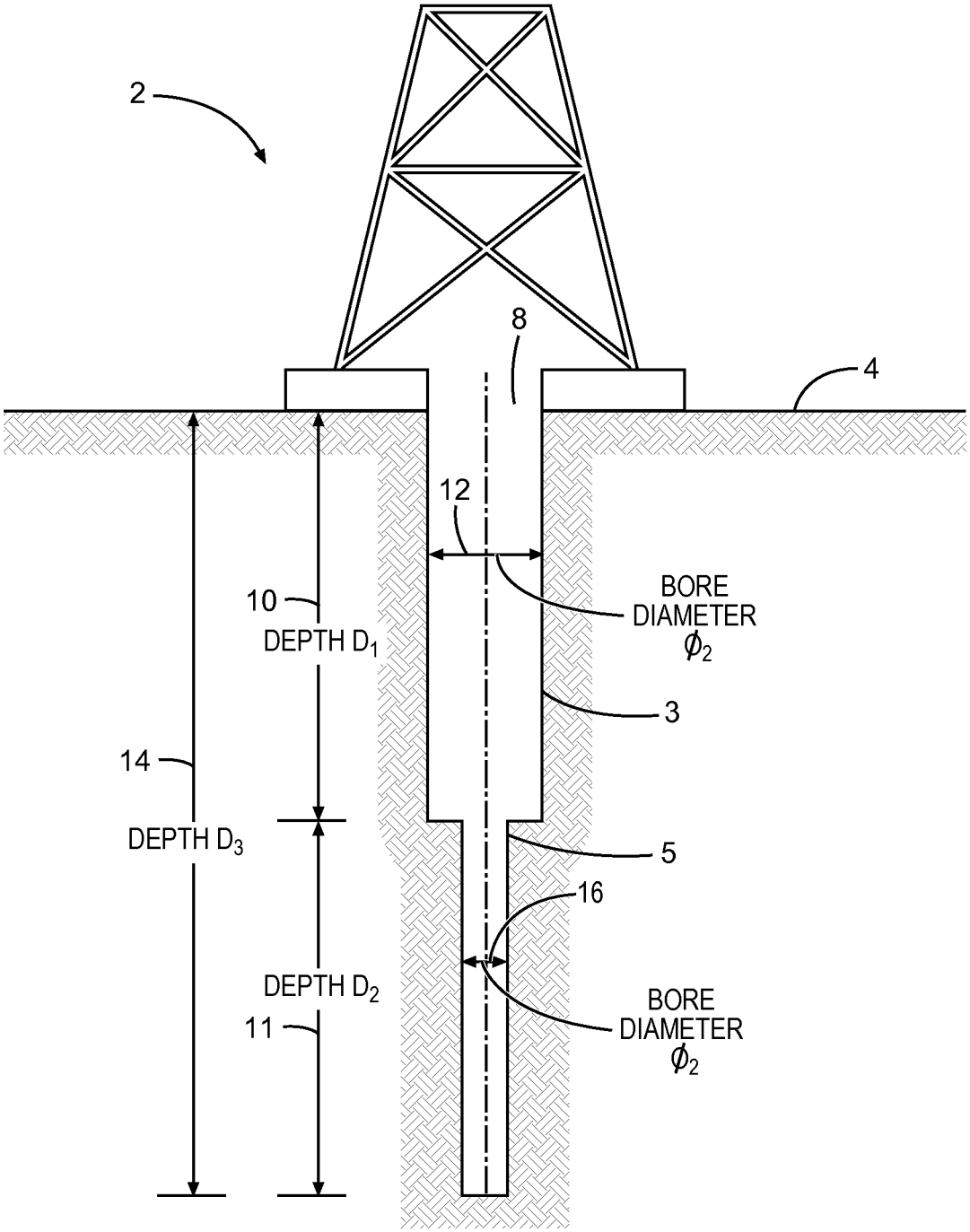
FIG. 1 illustrates generally a borehole having well borehole sections, according to various embodiments.

FIG. 1 illustrates generally a borehole 8 having well borehole sections 3 and 5, according to various embodiments. As shown, a drilling rig 2 is located on a surface 4 above the borehole 8, so as to provide a drilling assembly, as discussed herein. The borehole 8 is formed by penetrating a subterranean formation 6 with a drilling assembly, such as a nested drill bit assembly, as discussed herein. As shown, the borehole 8 has a total depth 14 (D3) including two borehole sections 3 and 5. The first borehole section 3 includes a depth 10 (D1) and a diameter 12 (Φ1) and the second borehole section 5 includes a depth 11 (D2) and a diameter 16 (Φ2). Generally, the first borehole section (e.g., the borehole closest to the surface 4) has the greatest diameter and the further the borehole penetrates the subterranean formation 6, the smaller the borehole section diameter becomes. For example, as shown, the first borehole section 3 diameter 12 (Φ1) is greater than the second borehole section 5 diameter 16 (Φ2). In an example, the borehole section 3 depth 10 (D1) is less than, substantially equal to, or greater than the borehole section 5 depth 11 (D2). That is, individual borehole section depths are, in an example, independent or other borehole sections. In an example, the borehole section depth is based on one or more subterranean formation property, such as density, composition, or the like.

Figure 2:
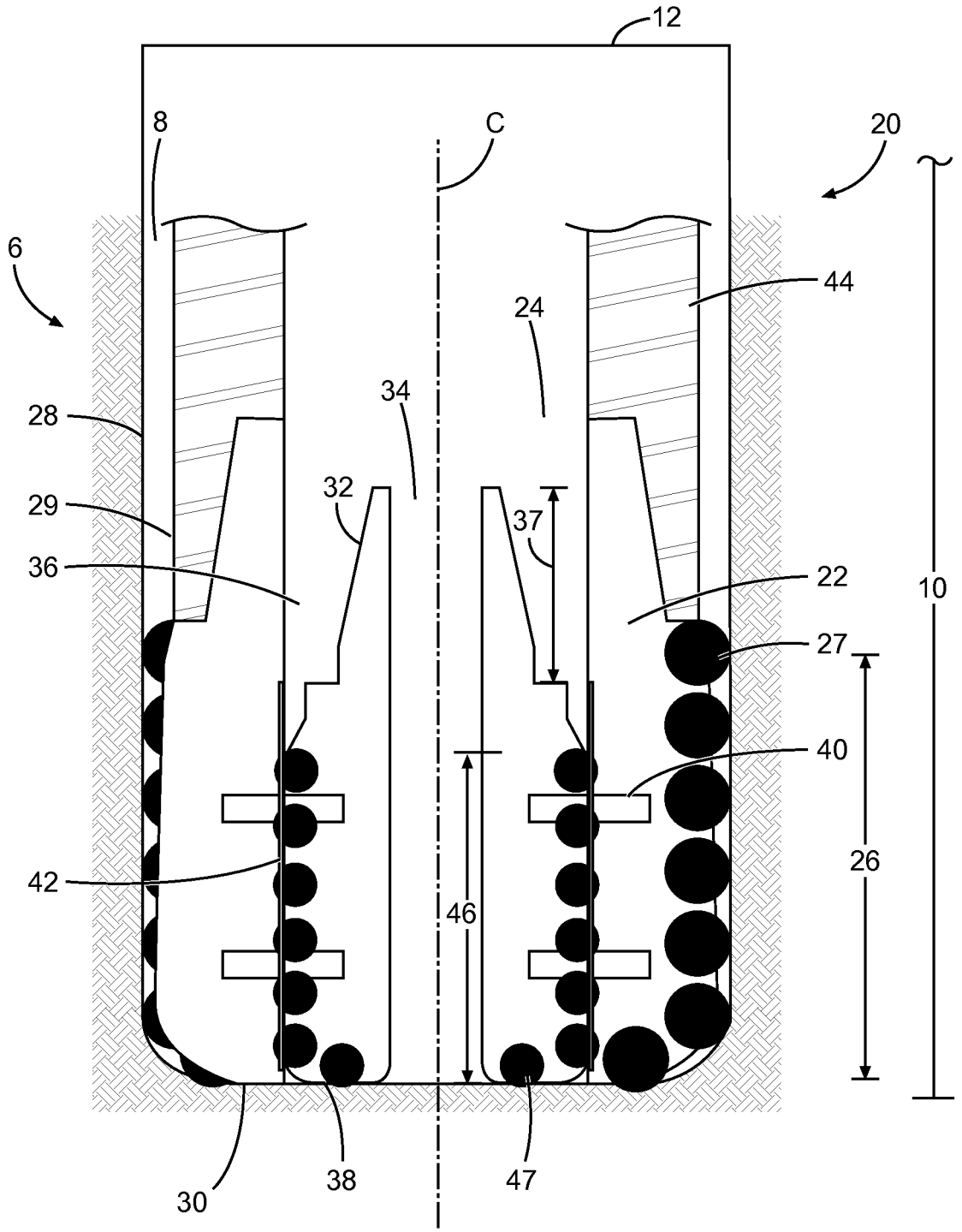
FIG. 2 illustrates a perspective view of nested drill bit assembly, according to various embodiments.

FIG. 2 illustrates a perspective view of nested drill bit assembly 20, according to various embodiments. As shown, the nested drill bit assembly 20 is located within the borehole 8. The nested drill bit assembly 20, in an example, is configured to drill the borehole 8 having a diameter 12 (Φ1), as shown in FIG. 1. As shown, the nested drill bit assembly 20 is located, at the depth 10 (D1), as shown in FIG. 1. The nested drill bit assembly 20 includes an outer drill bit 22 and an inner drill bit 32 nested within an outer drill bit bore 24 of the outer drill bit 22. The outer drill bit 22 includes, in an example, an outer cutting portion 26. The outer cutting portion 26 includes, for example, one or more outer cutter 27. In an example, the one or more outer cutter 27 is configured to penetrate or drill various types of subterranean formations 6. For example, the outer drill bit 22, including the outer cutting portion 26, is configured to penetrate a variety of subterranean formations 6 expected at a drill location. As shown, the outer drill bit 22 includes an outer drill bit upper portion 28 and an outer drill bit bottom portion 30. The out drill bit upper portion 28 includes an outer drill bit engagement portion 29 configured to engage a drill stem (not shown) and a casing 44.

The inner drill bit 32 is removably coupled to the outer drill bit 29, such as with one or more shear pin 40. For example, the inner drill bit 32 is co-axially positioned within the outer drill bit bore 29 along the axis C. In an example, the inner drill bit 32 is removably coupled to the outer drill bit 22 such that the inner drill bit 32 can be decoupled and re-coupled to the outer drill bit 22. As shown, the drill bit assembly 20 includes a cap 42 disposed between at least a portion of the inner drill bit 22 and the outer drill bit 32. In an example, the cap 42 protects the inner drill bit cutting portion 46, including one or more inner drill bit cutter 47, from a bore wall of the outer drill bit 32. The cap 42 is, in an example, configured to at least partially disintegrate downhole, such as when the cap 42 is exposed to a drilling fluid (e.g., drilling mud) or a chemical substance fed downhole through borehole 8, the outer drill bit bore 24, the inner drill bit bore 34, or some combination thereof. For example, the cap 42 can comprise a water soluble or a water degradable polymer that at least partially degrades upon exposure to aqueous fluids (e.g., drilling mud) under downhole conditions. Such polymers include, but is not limited to, polyvinyl alcohol, polyvinyl acetate, hydroxyethyl cellulose, carboxymethyl cellulose, sodium carboxymethyl hydroxyethyl cellulose, methyl hydroxy propyl cellulose, derivatives of polyethylene glycol, starches, cellulose triester, polyethylene oxide, polyesters such as polylactate, or any combinations thereof. However, the cap 42 can comprise any material known to persons of ordinary skill in the art that can be dissolved, degraded, or disintegrated by a temperature or fluid such as water-based drilling fluids, hydrocarbon-based drilling fluids, or natural gas.

The inner drill bit 32 is, in an example, accessible within the outer drill bit bore 24, such as from the outer drill bit upper portion 28. For example, the inner drill bit 32 is, in an example, wire-line accessible, as described herein. As shown, the inner drill bit 32 includes an inner drill bit bore 34 configured to permit drilling fluids (e.g., drilling mud) to pass up to the surface (FIG. 1, 4) when the nested drill bit assembly 20 is positioned downhole. In an example, the inner drill bit 32 includes an inner drill bit upper portion 36 and an inner drill bit bottom portion 38. The inner drill bit upper portion 37 includes an inner drill bit engagement portion 36 configured to engage with a drill stem, a casing, or both. That is, drilling with in inner drill bit 32, in an example, is done with a casing string by itself or a drill stem by itself. In an example, the outer drill bit engagement portion 29 is configured to engage a drill stem and a casing 44 having a greater diameter than the inner drill bit engagement portion.

In an example, the nested drill bit assembly 20 is rotatable by a first drill stem, such as a drill stem engaged with the outer drill bit 22, when the nested drill bit assembly is disposed within the borehole 8.

Figure 3:
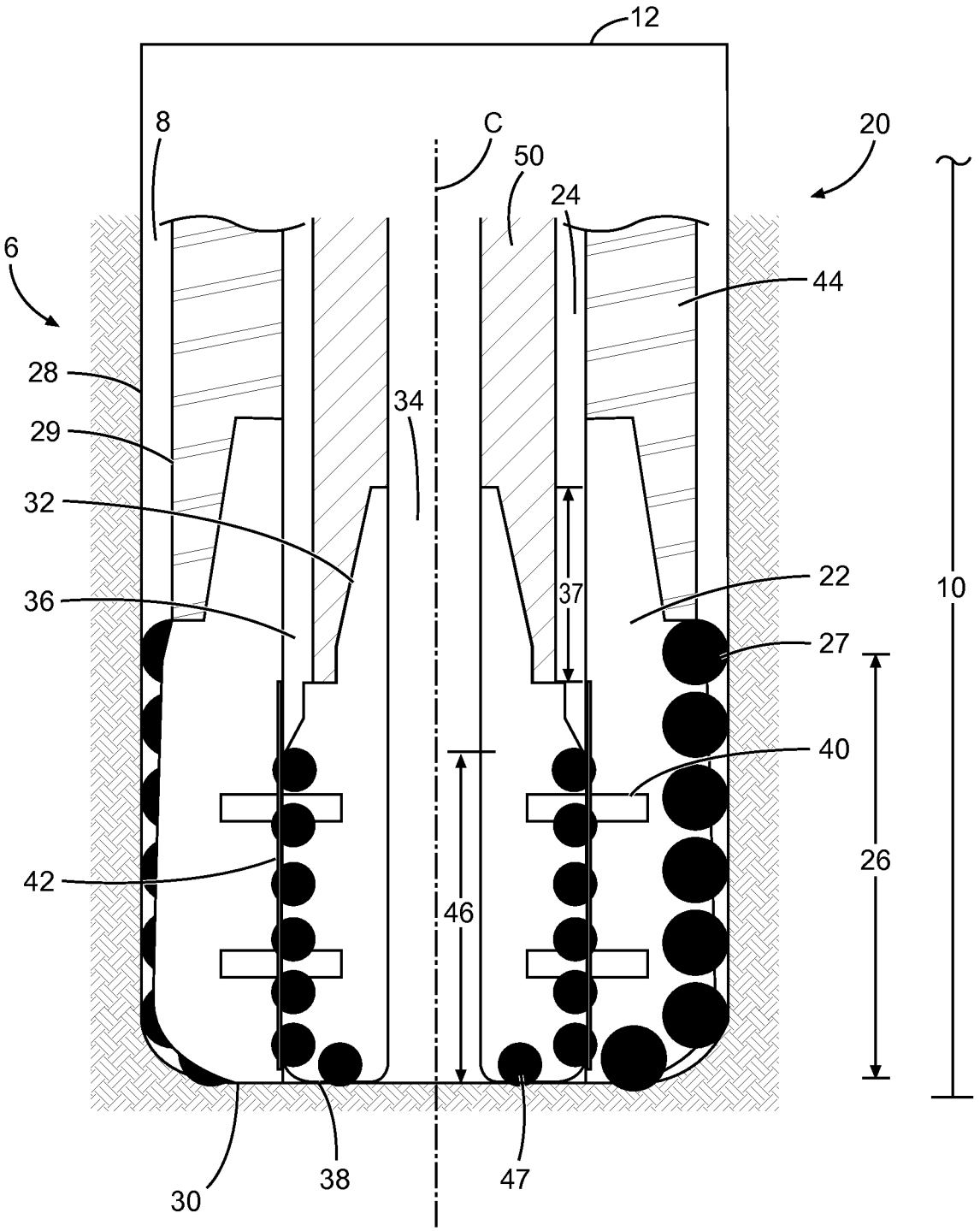
FIG. 3 illustrates a perspective view of a nested drill bit assembly including an inner drill stem, according to various embodiments.

FIG. 3 illustrates a perspective view of nested drill bit assembly 20, including an inner drill bit stem 50 (e.g., a second drill stem), according to various embodiments. The second drill stem 50 engages the inner dill bit engagement portion 36. The second drill stem 50 is configured to apply a downward force (e.g., in the downhole direction) to the inner drill bit 32.

Figure 4:
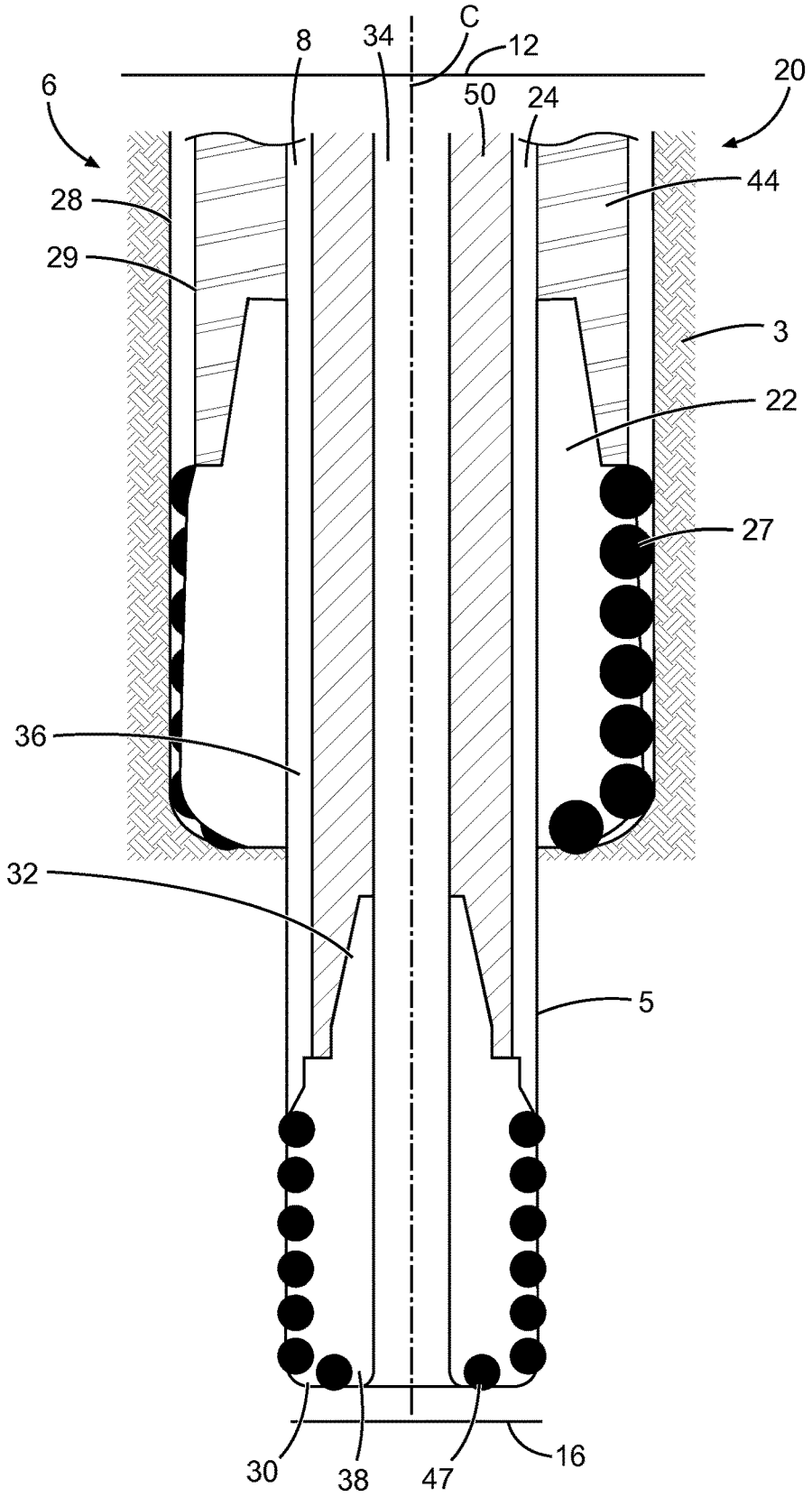
FIG. 4 illustrates a perspective view of a nested drill bit assembly with the inner drill bit decoupled from the outer drill bit, according to various embodiments.

FIG. 4 illustrates a perspective view of nested drill bit assembly 20, with the inner drill bit 32 decoupled from the outer drill bit 22. As shown in FIG. 4, the second drill stem 50 is applying a downward force to the inner drill bit 32 so as to shear the shear pins (40, FIGS. 2 and 3) and decouple the inner drill bit 32 from the outer drill bit 22. The second drill stem 50 rotates the inner drill bit 32 and applies a downward force to bore a second borehole section 5. As discussed herein, the second borehole section 5 has a second diameter 16 (Φ2) smaller than a first diameter 12 (Φ1) of a first borehole section 3. As is apparent, the first diameter 12 (Φ1) corresponds with an outer diameter of the outer drill bit 22 and the second diameter 16 (Φ2) corresponds with an outer diameter of the inner drill bit 32. Drilling fluid is permitted to flow within the inner drill bit bore 34. Although FIG. 4 illustrates the inner drill bit 32 further downhole of the outer drill bit 22, the inner drill bit 32, in an example, is decoupled from the outer drill bit 22 and pulled out of the bore hole 8 by the second drill stem 50 or a wireline system.

Figure 5:
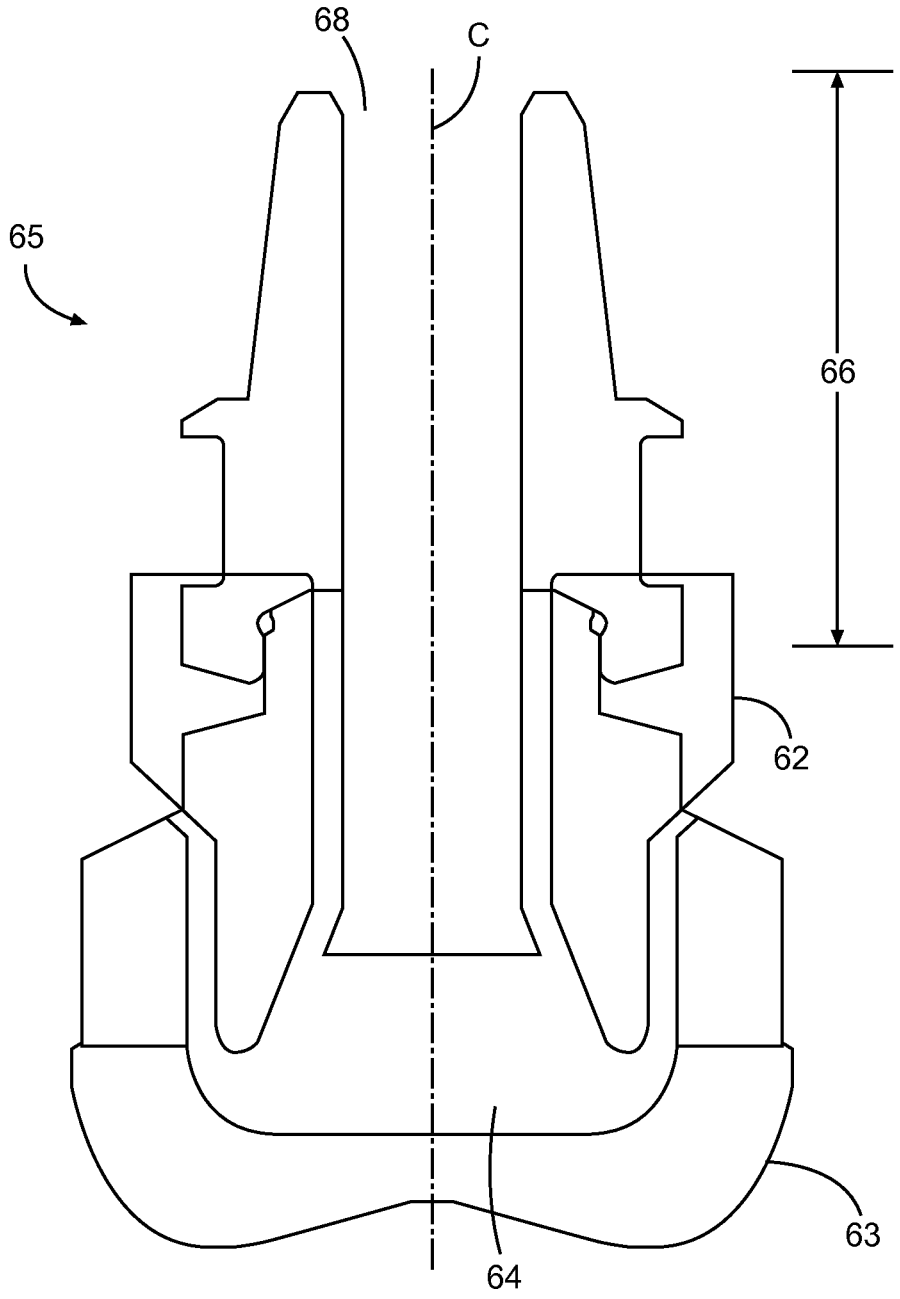
FIG. 5 illustrates a perspective view of a nested drill bit assembly including a plug, according to various embodiments.

FIG. 5 illustrates a perspective view of a nested drill bit assembly 60, according to various embodiments. In an example, the nested drill bit assembly 60 includes an outer drill bit 62 and an inner drill bit 64 nested within a bore 68 of the outer drill bit 62. The inner drill bit 64, in an example, is nested toward a bottom portion 63 of the outer drill bit 62 or the inner drill bit 64 is nested within the bore 68 towards an upper portion 65 of the outer drill bit 62. In an example, the upper portion 65 includes an engagement portion 66 for engaging a drill stem or a casing. As shown in FIG. 5, the inner drill bit 64, in an example, is a plug. The inner drill bit 64 is configured to plug the bore 68 and add weight to the outer drill bit 62. As discussed herein, drilling varying earth formations involves using different drill bit assemblies. The inner drill bit 64, in an example, provides additional weigh to the nested drill bit assembly 60 to aid in drilling tougher or denser earth formations.

As discussed herein, the inner drill bit 64 is removably coupled to the outer drill bit 62. For example, the inner drill bit 64 is capable of being decoupled and recoupled within the outer drill bit bore 68. In an example, the nested drill bit assembly 60 includes multiple inner drill bits 64, each configured to be individually nested within the bore 68 of the outer drill bit 62. For example, an inner drill bit set can include multiple inner drill bits 64 each distinct from one another, such as by weight or other property. In an example, a first inner drill bit is decoupled from the outer drill bit and the inner drill bit is pulled up and out of the borehole by the drill stem or the wireline system. Then a second inner drill bit is fed downhole and is recoupled with the outer drill bit to form a new drill bit assembly including the second inner drill bit and the outer drill bit.

Figure 6:
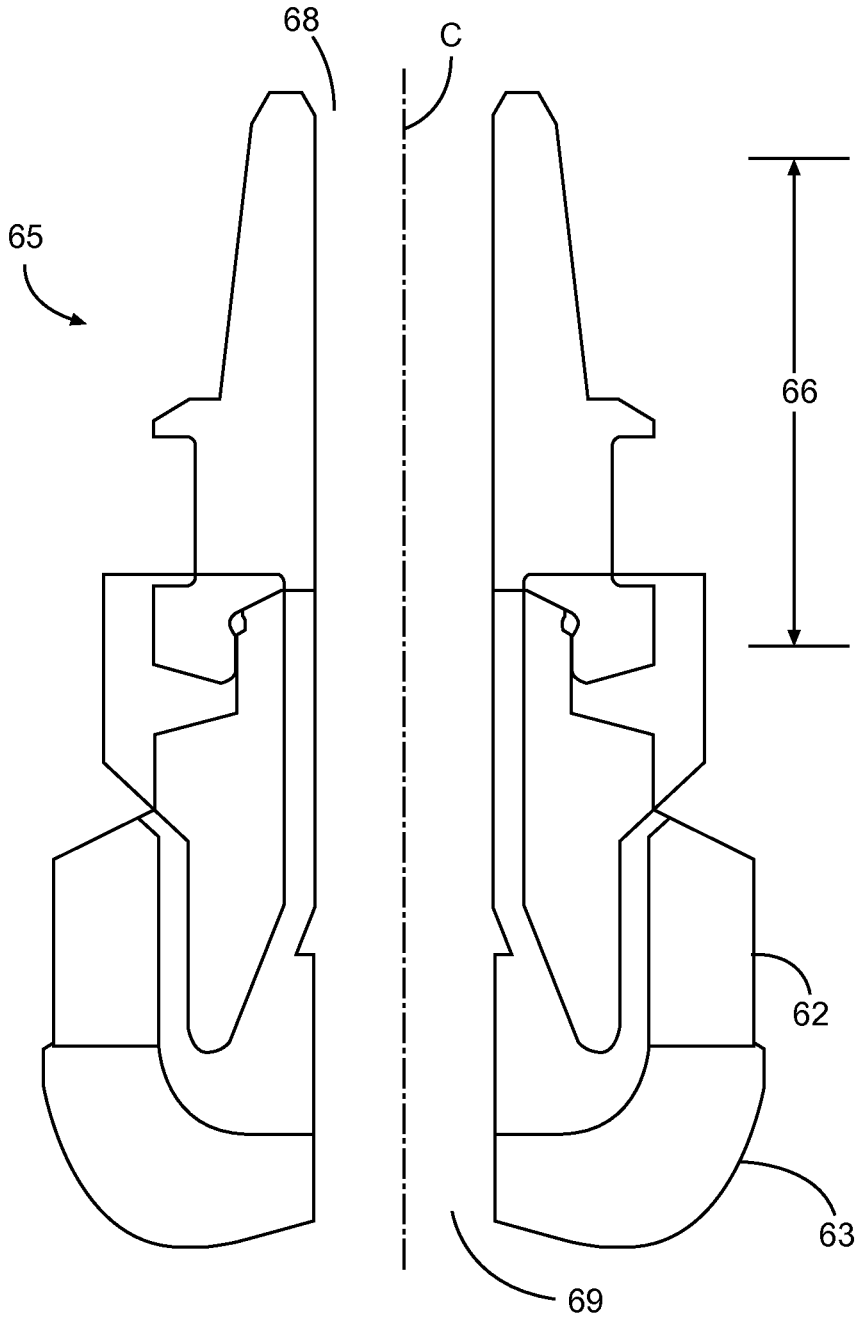
FIG. 6 illustrates a perspective view of an outer drill bit with a plug removed, according to various embodiments.

FIG. 6 illustrates a perspective view of an outer drill bit assembly 60 with the inner drill bit removed, according to various embodiments. As shown in FIG. 6, the bottom portion 63 of the outer drill bit 62 includes an opening 69. In an example the opening 69 is co-axial with the axis C of the bore 68. The opening 69 is in communication with the bore 68 such that the bore 68 is through the length of the outer drill bit 62.

Figure 7:
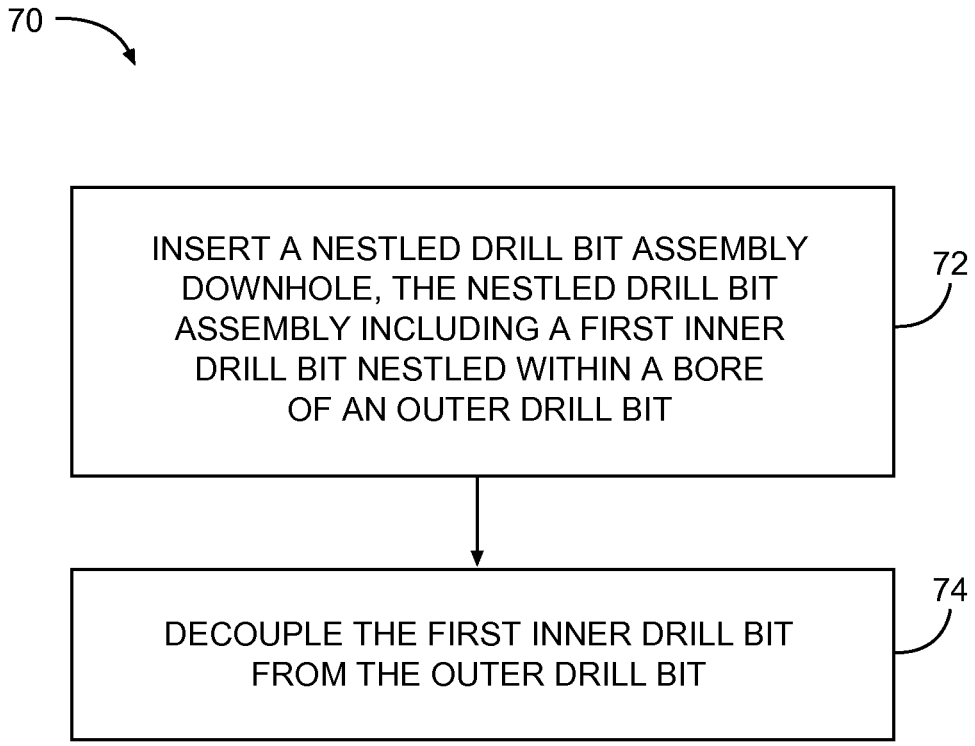
FIG. 7 illustrates a flow diagram of a method drilling a borehole in a formation, according to various embodiments.

FIG. 7 illustrates a flow diagram of a method 70 for drilling a borehole in a formation, according to various embodiments. At 72, the method 70 includes inserting a nested drill bit assembly downhole. The nested drill bit assembly, in an example, includes the features and components discussed herein. For example, the nested drill bit assembly includes a first inner drill bit nested within a bore of an outer drill bit, the inner drill bit removably coupled to the outer drill bit, the first inner drill bit being co-axially positioned within the outer drill bit and accessible from a first end of the outer drill bit.

The method 70 includes decoupling the first inner drill bit from the outer drill bit, at 74. As discussed herein the inner drill bit, in an example, is configured to decouple and recouple to the outer drill bit or is configured to be decouple without recoupling to the outer drill bit. In an example, the first inner drill bit engages a subterranean formation downhole of the outer drill bit. In such an example, the inner drill bit includes a cutting portion configured to drill a bore in the subterranean formation, such as a second bore segment, as described herein.

In an example, the method 70 includes removing the first inner drill bit from downhole, inserting a second inner drill bit within the bore of the outer drill bit, and coupling the second inner drill bit to the outer drill bit. In such an example, the inner drill bit is a plug, as described in reference to FIGS. 5 and 6.

Figure 8:
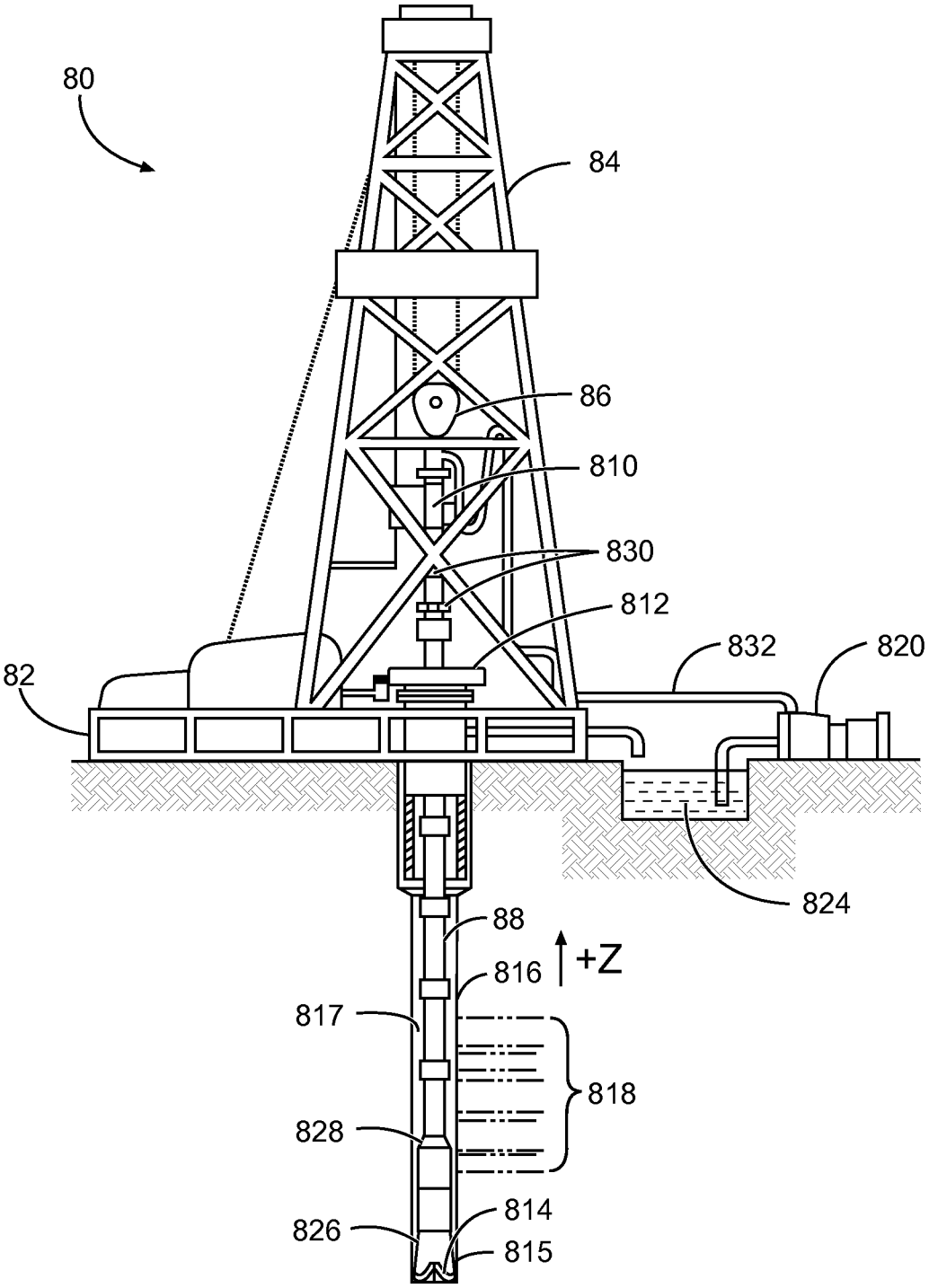
FIG. 8 illustrates generally an example of a wireline logging apparatus.

FIG. 8 illustrates generally an example of a drilling apparatus 8, such as including a measure-while-drilling (MWD) or log-while-drilling (LWD) capability. The illustrative example of FIG. 8 may include apparatus such as shown in FIGS. 2-6, or may be used with techniques discussed in relation to FIGS. 1-7. A drilling rig or platform 82 generally includes a derrick 84 or other supporting structure, such as including or coupled to a hoist 86. The hoist 86 may be used for raising or lowering equipment or other apparatus such as drill string 88. The drill string 88 may access a borehole 86, such as through a well head 82. The lower end of the drill string 88 may include various apparatus, such as a drill head 814, such as to provide the borehole 816.

A drilling fluid or "mud" 817 may be circulated in the annular region around the drill head 814 or elsewhere, such as provided to the borehole 816 through a supply pipe 822, circulated by a pump 820, and returning to the surface to be captured in a retention pit 824 or sump. Various subs or tool assemblies may be located along the drill string 88, such as include a bottom hole assembly (BHA) 826 or a second sub 828.

As the BHA 86 or second sub 88 pass through various regions of a formation 818, information may be obtained. For example, the BHA 826, or the second sub 828, may include a sensor 815 (e.g., a button, an electrode, as described herein) such as shown in the examples of FIGS. 2-6, such as to evaluate the formation including any mud effects. The second sub 828 may include wireless telemetry or logging capabilities, or both, such as to transmit or later provide information indicative of a formation resistivity to operators on the surface or for later access in evaluation of formation 818 properties, including depth. For example, portions 830 of the apparatus 80 at the surface may include one or more of wireless telemetry, processor circuitry, or memory facilities, such as to support log-while-drilling (LWD) or measurement-while-drilling (MWD) operations.

Figure 9:
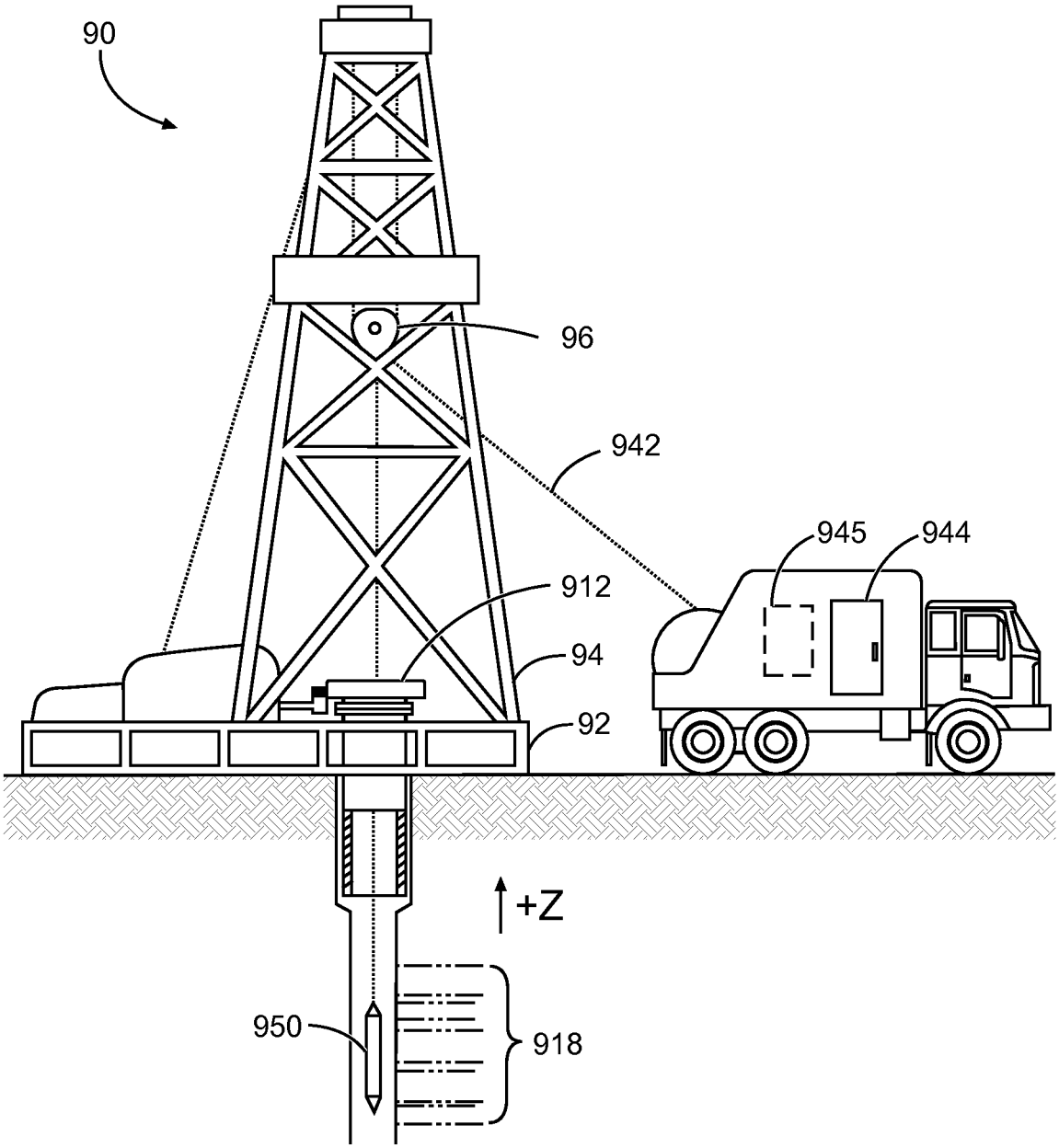
FIG. 9 illustrates generally an example of a wireline logging apparatus.

FIG. 9 illustrates generally an example of a wireline logging apparatus. The illustrative example of FIG. 9 may include a sensor such as shown in FIGS. 2-6, or may be used with techniques discussed in relation to FIGS. 1-7. Similar to the example of FIG. 8, a hoist 96 may be included as a portion of a platform 92, such as coupled to a derrick 94, and used to raise or lower equipment such as a wireline sonde 950 into or out of a borehole. In this wireline example, a cable 942 may provide a communicative coupling between a logging facility 944 (e.g., including a processor circuit 945 or other storage or control circuitry) and the sonde 950. In this manner, information about the formation 918 may be obtained, such as using an array log tool included as at least a portion of the sonde 950 as discussed in other examples herein.

For purposes of illustration, the examples of FIGS. 8 and 9 show a vertically-oriented borehole configuration. However, the apparatus and techniques described herein may also be used in other borehole configurations, such as a borehole including a horizontal penetration direction, or an oblique borehole configuration, for example. The examples of FIGS. 8 and 9 also generally illustrate land-based examples. But, apparatus and techniques described herein may be used in offshore environments as well, such as for subsea operations. In particular, offshore or subsea operations may include use of wireline or LWD/MWD apparatus and techniques including aspects of the examples herein.

To better illustrate the methods and articles for evaluating mud effects in imaging tool measurement disclosed herein, a non-limiting list of examples is provided:

Example 1 can include a nested drill bit assembly comprising an outer drill bit having an opening therethrough; and an inner drill bit nested within the opening of the outer drill bit, the inner drill bit releasably coupled to the outer drill bit and retrievable upon release through an upper portion of the outer drill bit.

Example 2 can include, or can optionally be combined with the subject matter of Example 1, wherein the inner drill bit is configured to engage with a first drill stem extending into the opening of the outer drill bit.

Example 3 can include, or can optionally be combined with the subject matter of Example 2, wherein the inner drill bit includes a drill stem engagement portion disposed toward an upper portion of the inner drill bit.

Example 4 can include, or can optionally be combined with the subject matter of Example 2, wherein the inner drill bit is configured to be axially movable beyond a bottom portion of the outer drill bit when the inner drill bit is engaged with the first drill stem.

Example 5 can include, or can optionally be combined with the subject matter of Example 1, wherein the outer drill bit is configured to engage with a second drill stem.

Example 6 can include, or can optionally be combined with the subject matter of Example 5, wherein the outer drill bit includes a drill stem engagement portion disposed toward an upper portion of the outer drill bit.

Example 7 can include, or can optionally be combined with the subject matter of Example 1, wherein the inner drill bit is co-axially positioned within the outer drill bit.

Example 8 can include, or can optionally be combined with the subject matter of Example 1, wherein the nested drill bit assembly is rotatable by a first drill string when the nested drill bit assembly is disposed within a borehole.

Example 9 can include, or can optionally be combined with the subject matter of Example 1, wherein the inner drill bit is configured to disengage the outer drill bit by a second drill string and the inner drill bit is rotatable when disengaged from the outer drill bit, the second drill string having an outer diameter smaller than the first drill string.

Example 10 can include, or can optionally be combined with the subject matter of Example 1, wherein the inner drill bit is interchangable with at least a secondary inner drill bit.

Example 11 can include, or can optionally be combined with the subject matter of Example 1, further comprising a cap at least partially disposed between an outer surface of the inner drill bit and an inner surface of the outer drill bit.

Example 12 can include, or can optionally be combined with the subject matter of Example 11, wherein the cap is configured to disintegrate downhole.

Example 13 can include, or can optionally be combined with the subject matter of Example 1, wherein the inner drill bit is releasably coupled to the outer drill bit with at least one shear pin.

Example 14 can include, or can optionally be combined with the subject matter of Example 1, wherein the inner drill bit is wire-line accessible.

Example 15 can include, or can optionally be combined with the subject matter of Example 1, wherein the inner drill bit includes an inner drill bit cutting portion.

Example 16 can include a method drilling a borehole in a formation, the method comprising: inserting a nested drill bit assembly downhole, the drill bit assembly including: an outer drill bit having an opening; and a first inner drill bit nested within the opening of the outer drill bit, the first inner drill bit releasably coupled to the outer drill bit and retrievable upon release through an upper portion of the outer drill bit; and decoupling the first inner drill bit from the outer drill bit.

Example 17 can include, or can optionally be combined with the subject matter of Example 16, further comprising engaging the first inner drill bit with a subterranean formation downhole of the outer drill bit.

Example 18 can include, or can optionally be combined with the subject matter of Example 16, further comprising: removing the first inner drill bit from downhole; inserting a second inner drill bit within the opening of the outer drill bit; and coupling the second inner drill bit to the outer drill bit.

Example 19 can include, or can optionally be combined with the subject matter of Example 16, wherein decoupling the first inner drill bit from the outer drill comprises applying a force to the first inner drill bit using a first drill stem.

Example 20 can include, or can optionally be combined with the subject matter of Example 16, wherein decoupling the first inner drill bit from the outer drill comprises breaking a shear pin that coupled the first inner drill bit to the outer drill bit.

What is claimed is:

1. A nested drill bit assembly for drilling a borehole, comprising:

an outer drill bit having an opening therethrough and rotatable to drill the borehole at a first diameter; and an inner drill bit nested within the opening of the outer drill bit, the inner drill bit releasably coupled to the outer drill bit, releasable to extend beyond a bottom portion of the outer drill bit upon release from the outer drill bit, rotatable to extend the borehole at a second diameter that is smaller than the first diameter, and retrievable upon release from the outer drill bit through an upper portion of the outer drill bit.

2. The nested drill bit assembly of claim 1, wherein the inner drill bit is configured to engage with a first drill stem extending into the opening of the outer drill bit.

3. The nested drill bit assembly of claim 2, wherein the inner drill bit includes a drill stem engagement portion disposed toward an upper portion of the inner drill bit.

4. The nested drill bit assembly of claim 2, wherein the inner drill bit is operable to extend beyond the bottom portion of the outer drill bit upon release from the outer drill bit when the inner drill bit is engaged with the first drill stem.

5. The nested drill bit assembly of claim 2, wherein the outer drill bit is configured to engage with a second drill stem.

6. The nested drill bit assembly of claim 5, wherein the outer drill bit includes a drill stem engagement portion disposed toward an upper portion of the outer drill bit.

7. The nested drill bit assembly of claim 1, wherein the inner drill bit is co-axially positioned within the outer drill bit.

8. The nested drill bit assembly of claim 1, wherein the nested drill bit assembly is rotatable by a first drill string when the nested drill bit assembly is disposed within a borehole.

9. The nested drill bit assembly of claim 8, wherein the inner drill bit is configured to disengage the outer drill bit by a second drill string and the inner drill bit is rotatable when disengaged from the outer drill bit, the second drill string having an outer diameter smaller than the first drill string.

10. The nested drill bit assembly of claim 1, wherein the inner drill bit is interchangeable with at least a secondary inner drill bit.

11. The nested drill bit assembly of claim 1, further comprising a cap at least partially disposed between an outer surface of the inner drill bit and an inner surface of the outer drill bit.

12. The nested drill bit assembly of claim 11, wherein the cap is configured to disintegrate downhole.

13. The nested drill bit assembly of claim 1, wherein the inner drill bit is releasably coupled to the outer drill bit with at least one shear pin.

14. The nested drill bit assembly of claim 1, wherein the inner drill bit is wire-line accessible.

15. The nested drill bit assembly of claim 1, wherein the inner drill bit includes an inner drill bit cutting portion.

16. A method drilling a borehole in a formation, the method comprising:

inserting a nested drill bit assembly downhole, the drill bit assembly including:

an outer drill bit having an opening; and a first inner drill bit nested within the opening of the outer drill bit, the first inner drill bit releasably coupled to the outer drill bit, operable to extend beyond a bottom portion of the outer drill bit upon release from the outer drill bit, and retrievable upon release through an upper portion of the outer drill bit; then rotating the nested drill bit assembly to drill the borehole at a first diameter;

decoupling the first inner drill bit from the outer drill bit; and then rotating the first inner drill bit to extend the borehole at a second diameter that is smaller than the first diameter.

17. The method of claim 16, further comprising engaging the first inner drill bit with a subterranean formation downhole of the outer drill bit.

18. The method of claim 16, further comprising: removing the first inner drill bit from downhole; inserting a second inner drill bit within the opening of the outer drill bit; and coupling the second inner drill bit to the outer drill bit.

19. The method of claim 16, wherein decoupling the first inner drill bit from the outer drill comprises applying a force to the first inner drill bit using a first drill stem.

20. The method of claim 16, wherein decoupling the first inner drill bit from the outer drill comprises breaking a shear pin that coupled the first inner drill bit to the outer drill bit.

* * * * *